United States Patent [19]

Teng

[11] 4,163,411

[45] Aug. 7, 1979

[54] BREECH CLOSURE MECHANISM

[75] Inventor: Robert N. Teng, Huntington Beach, Calif.

[73] Assignee: The United States of America as represented by the Secretary of the Air Force, Washington, D.C.

[21] Appl. No.: 865,467

[22] Filed: Dec. 29, 1977

[51] Int. Cl.[2] ..... F41F 1/00

[52] U.S. Cl. ..... 89/1 H; 73/12; 73/432 SD

[58] Field of Search ..... 73/12, 147, 167, 432 SD; 89/1 R, 1 H, 17

[56] References Cited

U.S. PATENT DOCUMENTS 3,398,571 11/1965 Montgomery et al. ..... 73/12

*Primary Examiner*—Stephen C. Bentley

*Attorney, Agent, or Firm*—Joseph E. Rusz; Arsen Tashjian

[57] ABSTRACT

A mechanism for releasably holding and pre-heating a model, prior to launch of the model by and from a gun. The model is initially held in a collar of the mechanism in the breech of the gun, and is pre-heated by an induction coil and an r-f current. The coil is then removed, and the model and the collar are propelled forward through the breech by pressurized hydrogen gas, with the breech being closed and with the heated model being inserted into the launch tube (i.e., the "barrel") the gun. The gun is then fired, and the heated model is launched, without any significant cooling of the model. Some advantages of this mechanism are a quick "heat-and-fire" cycle, and the simplicity in structure and in operation of the mechanism.

6 Claims, 4 Drawing Figures

BREECH CLOSURE MECHANISM

STATEMENT OF GOVERNMENT INTEREST

The invention described herein may be manufactured and used by or for the Government for governmental purposes without the payment of any royalty thereon.

BACKGROUND OF THE INVENTION

This invention relates to a breech closure mechanism and, more particularly, to such a mechanism which is a constituent component of a gun that is capable of launching a model when the gun is fired.

Model launchers per se are not new. However, an inherent problem, where the model is to be launched after having been pre-heated to a preselected temperature, has been the significant and undesirable cooling of the model between the time that the model is heated and the time when the model is, in fact, launched.

I have invented a breech closure mechanism, for a model launcher gun, which obviates this long-standing problem; and, thereby, I have significantly advanced the state-of-the-art.

SUMMARY OF THE INVENTION

This invention pertains to a unique breech closure mechanism for a model launcher gun, which said mechanism permits a quick "heat-and-fire" cycle of a modle to be launched, thereby accomplishing the launch of the heated model without any significant cooling of the model between the heating of the model to the desired preselected temperature and the launching of the model by the firing of the fun.

Accordingly, the principal object of this invention is to teach the structure of a preferred embodiment of my above-described inventive breech closure mechanism.

This principal object, as well as other related objects (e.g., simplicity of structure and of operation of the mechanism, ready adaptability of the mechanism to existing gun hardware, and a high degree of safety in use of the mechanism), will become readily apparent after a consideration of the description of the inventive mechanism, together with reference to the Figures of the drawings.

DESCRIPTION OF THE PREFERRED EMBODIMENT

Figure 1:
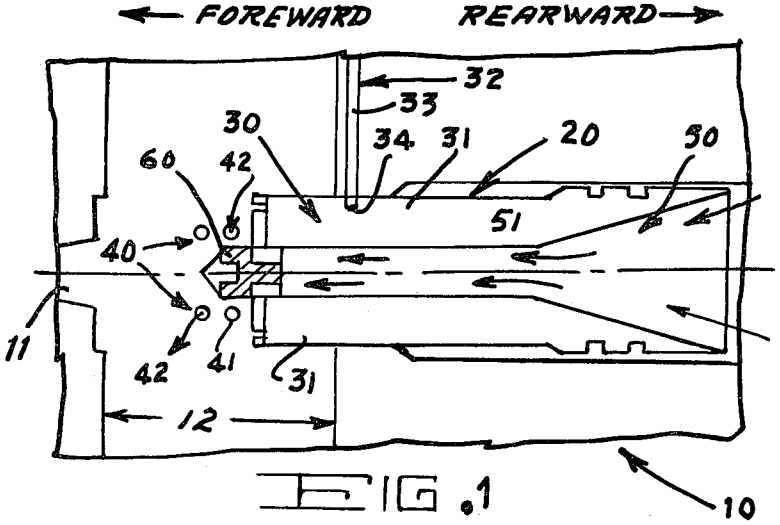
FIGS. 1–4, inclusive, of the drawings, are side elevation views, in simplified schematic form and partially fragmented, of a preferred embodiment of my inventive breech closure mechanism, of the model to be pre-heated and launched, and of associated components of the model launcher gun, during various stages of the closing of the breech of the gun. As a matter of preference, and of convenience, the model to be pre-heated and launched is shown partially in cross section.
Figure 2:
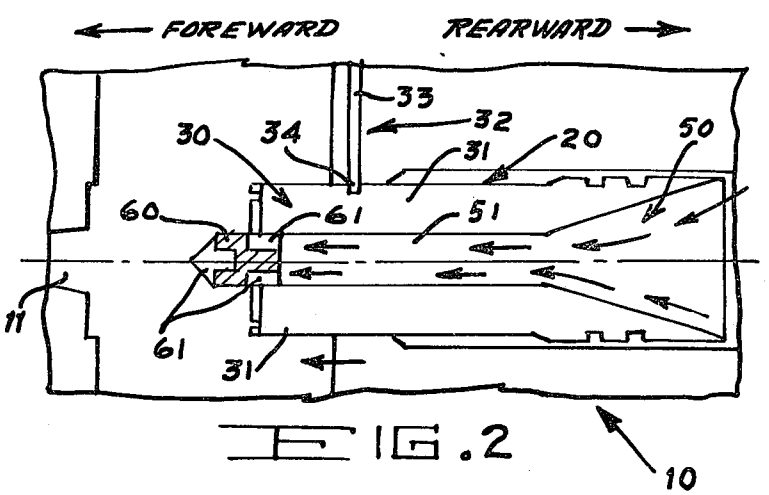
Figure 3:
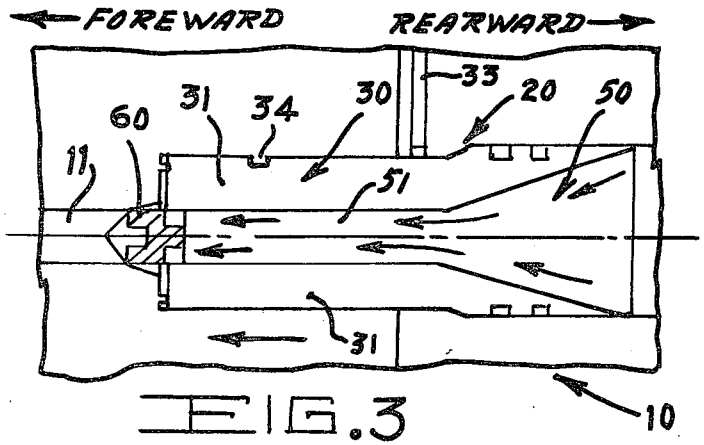
Figure 4:
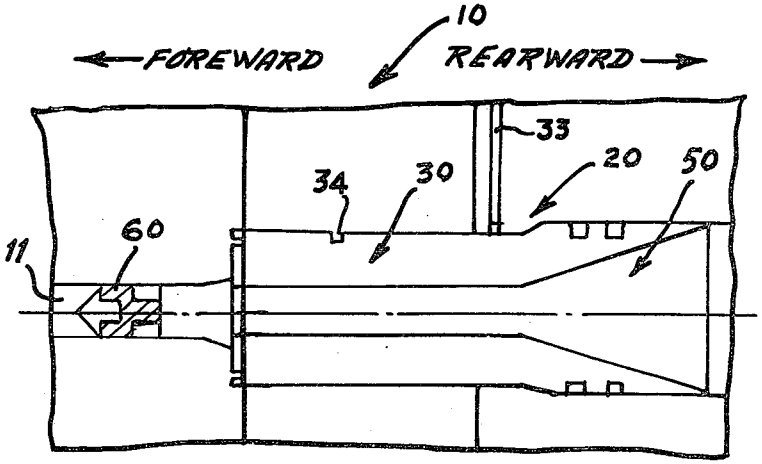

With reference to FIGS. 1–4, inclusive, it is to be noted that the preferred embodiment 20 of my breech closure mechanism is adapted for use as a constituent component of a model launcher gun 10 having a launch tube 11 (i.e., a "barrel") and a breech 12 (i.e., a space) to the rear of the launch tube. The model to be pre-heated and launched is designated 60.

In the interest of orienting the reader, the directional designations "Forward" and "Rearward" are shown in the Figures, together with their respective corresponding arrows.

In its most basic and generic structural form, my breech closure mechanism comprises: a means, generally designated 30, for releasably holding the model 60 to be pre-heated, and thereafter to be launched by the firing of gun 10, with this means 30 including a slidably movable collar 31 (as shown by the arrow along the side of it) disposed to the rear of the launch tube 11 and also simultaneously disposed in the breech 12; a means, generally designated 40, for heating the releasably held model 60 to a (desired) preselected temperature, with this means 40 operatively associated with the releasable holding means 30, and also with this means 40 removably positioned in the breech 12; and, means, generally designated 50, for propelling (i.e., moving forwardly) the releasable holding means 30, and also for simultaneously propelling the heated and releasably held model 60, toward and to the launch tube 11, with this means 50 operatively associated with the releasable holding means 30, and also with this means 50 disposed to the rear of the slidably movable collar 31 of the releasable holding means 30.

More specifically, the means 30 for releasably holding the model 60 further includes means, generally designated 32, for retractably locking (i.e., locking and unlocking) the slidably movable collar 31. As a matter of preference, rather than of limitation, this retractable locking means 32 includes a retractable locking pin 33, and a complementarily sized cavity 34 in the slidably movable collar 31, with the cavity 34 in alignment with the retractable locking pin 33 when the collar 31 is in the locked position, FIG. 1.

Also, the means 40 for heating the releasably held model 60 to a preselected temperature preferably includes an inducation coil 41 surrounding the releasably held model 61, FIG. 1, with an R-F (i.e., radio-frequency) current entering into and passing through the induction coil 41, as schematically represented by the directional arrows designated 42.

Further, the means 50 for propelling the releasable holding means 30, and the heated and releasably held model 60, toward and to the launch tube 11 preferably includes a light gas (such as hydrogen), schematically represented by directional arrows designated 51, under pressure that propels the slidably movable collar 31 forwardly when the retractable pin 33 is withdrawn from cavity 34.

MANNER OF OPERATION OF THE PREFERRED EMBODIMENT

The manner of operation of the preferred embodiment 20 of my breech closure mechanism can be easily ascertained by any person of ordinary skill in the art from the foregoing description, coupled with reference to the Figures of the drawings.

For others, it is sufficient to say in explanation that, what occurs in sequence is essentially as follows. The model 60, which is to be pre-heated and launched, is initially held in the slidably movable collar 31 in the breech 12 of the gun 10. The collar 31, under the force of a pressurized light gas 51 (such as hydrogen), is held stationary by the retractable locking pin 33 that is in cavity 34. Then, an induction coil 41 is placed over (to surround) the model 60 which is now to be heated. Next, the R-F current is made to enter the coil 41, and the model 60 is quickly heated. Then, when the temperature of the model 60 reaches the preselected temperature, the coil 41 is removed, and the pin 33 is retracted from the cavity 34. As a result, the collar 31 and the heated model 60 are then propelled forward by the pressurized gas 51 toward and to the launch tube 11, thereby closing the breech (i.e., "eliminating" the space) 12. Then, the heated model 60 is inserted into the launch tube 11, and is released therein by the releasable holding means 30. Next, the gun 10 is fired, thereby launching the heated model 60 from the launch tube 11, without any significant cooling of the heated model 60.

CONCLUSION

It is abundantly clear from all of the foregoing, and from the Figures of the drawings, that the desired principal object, as well as the other related and stated objects, of the invention have been achieved.

It is to be noted that, although there have been described the fundamental and unique features of my invention as applied to a preferred embodiment 20, various other embodiments, variations, adaptations, substitutions, additions, omissions, and the like may occur to, and can be made by, those of ordinary skill in the art, without departing from the spirit of my invention. For example, model 60 may not be configurated so as to be readily accepted and releasably held by collar 31. In such a situation, the model 60 may be encased, surrounded, and the like by a sabot (i.e., a carrier) 61, FIG. 2, which is appropriately configurated to be accepted and releasably held by collar 31.

What is claimed is:

1. A breech closure mechanism for a model launcher gun having a launch tube and a breech to the rear of said launch tube, comprising:

a. means for releasably holding a model to be launched by firing said gun, wherein said means includes a slidably movable collar disposed to the rear of said launch tube and in said breech;

b. means for heating said releasably held model to a preselected temperature, with said heating means operatively associated with said releasable holding means and removably positioned in said breech;

c. and, means for propelling said releasable holding means, and said heated and releasably held model, to said launch tube, with said propelling means operatively associated with said releasable holding means and disposed to the rear of said slidably movable collar of said releasable holding means;

whereby said breech is closed, and whereby said heated model is inserted into said launch tube and is released therein by said releasable holding means, and also whereby said gun is then fired, thereby launching said heated model without any significant cooling thereof.

2. A breech closure mechanism, as set forth in claim 1, wherein said means for releasably holding said model to be launched further includes means for retractably locking said slidably movable collar.

3. A means for retractably locking said slidably movable collar, as set forth in claim 2, wherein said means includes a retractable locking pin, and a complementarily sized cavity in said slidably movable collar, with said cavity in alignment with said retractable locking pin.

4. A breech closure mechanism, as set forth in claim 3, wherein said means for heating said releasably held model to a preselected temperature includes an induction coil surrounding said releasably held model, with an R-F current entering into and passing through said induction coil.

5. A breech closure mechanism, as set forth in said claim 4, wherein said means for propelling said releasable holding means, and said heated and releasably held model, to said launch tube includes a light gas under pressure propelling said slidably movable collar of said releasable holding means.

6. A breech closure mechanism, as set forth in claim 5, wherein said light gas of said propelling means in hydrogen.

* * * * *